US005820257A

United States Patent [19]

Musil

[11] Patent Number: 5,820,257

[45] Date of Patent: Oct. 13, 1998

[54] ASPHALT PLANT HAVING SILO WITH DYNAMIC INPUT AND OUTPUT MASS MONITORING DEVICES

[75] Inventor: Joseph E. Musil, Ely, Iowa

[73] Assignee: Cedarapids, Inc., Cedar Rapids, Iowa

[21] Appl. No.: 688,539

[22] Filed: Jul. 30, 1996

[51] Int. Cl.[6] ..... B28C 5/46; B28C 7/04

[52] U.S. Cl. ..... 366/22; 366/141

[58] Field of Search ..... 366/6–8, 18, 22–25, 366/141, 192; 432/108, 111, 117; 34/135–137

[56] References Cited

U.S. PATENT DOCUMENTS

| | | | |
|---|---|---|---|
| 2,190,044 | 2/1940 | Pollitz . | |
| 2,608,394 | 8/1952 | Williamson . | |
| 3,091,369 | 5/1963 | Sackett, Sr. . | |
| 3,106,384 | 10/1963 | Preeman | 366/22 |
| 3,129,779 | 4/1964 | Clements . | |
| 3,218,044 | 11/1965 | Domenighetti . | |
| 3,379,420 | 4/1968 | Maier . | |
| 3,809,373 | 5/1974 | Brock | 366/22 X |
| 3,866,887 | 2/1975 | Potter . | |
| 4,103,350 | 7/1978 | Brock et al. | 366/22 |
| 4,579,458 | 4/1986 | Ohlson | 366/23 X |
| 4,715,720 | 12/1987 | Brock | 366/25 |
| 5,090,813 | 2/1992 | McFarland et al. | 366/25 X |
| 5,209,563 | 5/1993 | Swisher, Jr. et al. | 366/22 |
| 5,251,976 | 10/1993 | Milstead . | |
| 5,378,060 | 1/1995 | Brock et al. | 366/25 X |
| 5,383,725 | 1/1995 | Swisher, Jr. et al. | 366/22 |
| 5,579,587 | 12/1996 | Morrison et al. | 366/25 X |

*Primary Examiner*—Charles E. Cooley
*Attorney, Agent, or Firm*—Marshall, O'Toole, Gerstein, Murray & Borun

[57] ABSTRACT

A storage silo system and an asphalt plant having the storage silo system, each including a silo bin, an input monitor arrangement for dynamically monitoring the mass of a flowable dry material being introduced into the silo bin, and an out monitor arrangement for dynamically monitoring the mass of the material being dispensed from the silo bin. The system includes a control unit which, in conjunction with the input and output monitor arrangements, dynamically monitors and controls the mass of the material contained in the silo bin. The input and output monitor arrangements each include a gravimetric weigh device having an enclosed, flexible wall belt scales and a clean-out auger for removing material that has fallen from the belt within the enclosure. The system may include an input bypass arrangement for adding additional portions of the material to the bin and an output bypass arrangement for removing additional portions of the material from the bin. An asphalt plant having the storage silo system is enabled to compensate for differences between rate of generation of mineral fill "dust" and demand rate for the "dust" for producing asphalt products.

19 Claims, 2 Drawing Sheets

FIG. 1
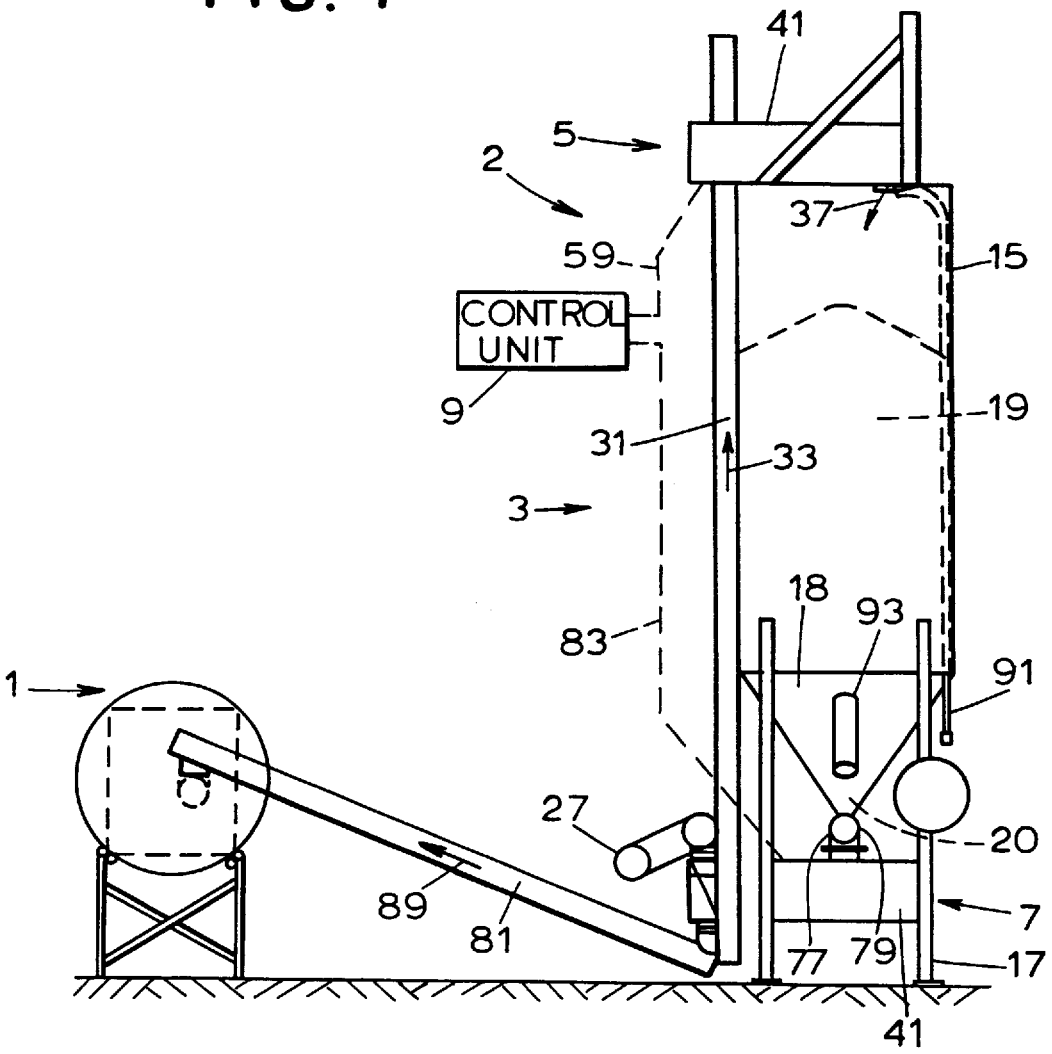
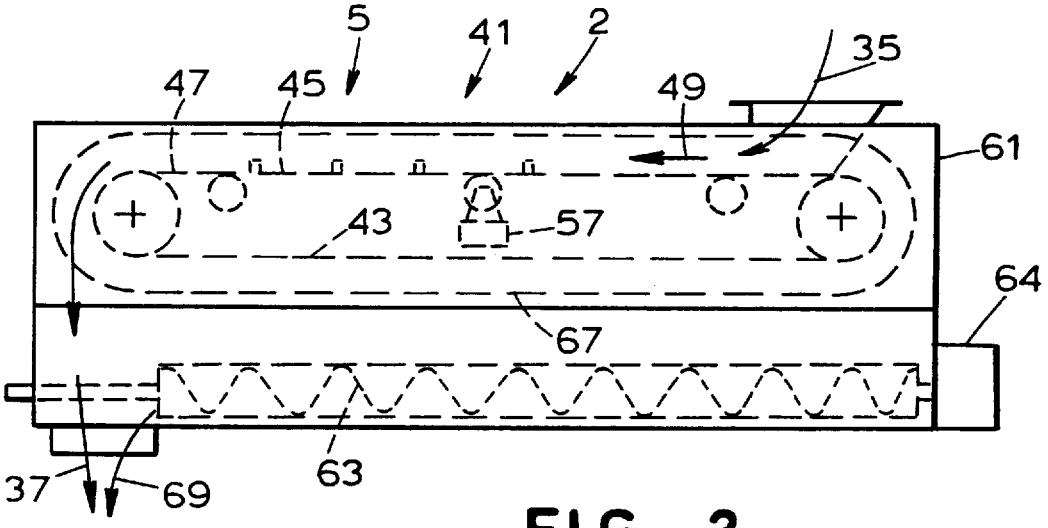
FIG. 3

ASPHALT PLANT HAVING SILO WITH DYNAMIC INPUT AND OUTPUT MASS MONITORING DEVICES

BACKGROUND OF THE INVENTION

1. Field of the Invention

The present invention relates generally to an asphalt plant having a storage container for storing flowable dry material and, more particularly, to an asphalt plant having a storage silo for receiving and dispensing mineral fill, fines and the like.

2. Description of the Related Art

The production of asphalt products, such as hot mix asphalt for asphalt paving, requires various ingredients, including mineral fill or fines to obtain the desired physical characteristics, both during processing of the asphalt products and as exhibited by the final product. Plants for producing the asphalt products generally utilize a rotary drum dryer wherein a hot gas stream is directed through the drum dryer to dry and heat materials, such as virgin aggregate, being processed therethrough. As the hot gas stream interacts with the materials in the drum, particulate matter—generally referred to as dust—becomes entrained in the hot gas stream and is exhausted from the drum along with the hot gases from the hot gas stream.

The entrained particulate matter is removed from the exhausted hot gases by passing the hot gases through a cyclone separator, a baghouse, a combination of a cyclone separator and a baghouse, or any other suitable arrangement. The quantity of particulate matter so separated from the hot gases can become excessive over time. Fortunately, a certain amount of mineral fill, or fines is generally a desired additive to the asphalt products being processed in the asphalt plant in order to obtain the desired consistency and physical characteristics. Generally, most or all of that mineral fill requirement can be satisfied by using the particulate matter as a certain percentage ratio of the ingredients being used to produce the asphalt products. Unfortunately, the rate at which the particulate matter is separated from the hot gases may vary or differ from the rate that mineral fill is needed for the particular design mix concurrently being produced by the asphalt plant.

Thus, what is needed is a buffering-type arrangement and an asphalt plant having a buffering-type arrangement wherein particulate matter being removed at a greater rate than needed for mineral fill in concurrently produced asphalt products can be temporarily accumulated for subsequent use, and where temporarily stored particulate matter can be used to satisfy a deficiency wherein mineral fill needed for producing asphalt products is greater than the quantity of particulate matter being concurrently provided by the asphalt plant producing the asphalt products.

SUMMARY OF THE INVENTION

An improved storage silo system and an improved asphalt plant having a storage silo system are provided having devices for dynamically monitoring the mass of a flowable dry material being introduced therein, the mass of the material contained therein, and the mass of the material being removed therefrom. The storage silo system and the asphalt plant having a storage silo system each include a bin or silo adapted to contain the material, an input monitor arrangement adapted to dynamically monitor the mass of the material being conveyed into the bin, an output monitor arrangement adapted to dynamically monitor the mass of the material being conveyed from the bin means, and a control unit adapted to dynamically monitor and control, in cooperation with the input and output monitor arrangements, the mass of the material contained in the bin.

Each of the input and output monitor arrangements generally include a gravimetric weigh device having an enclosure, flexible wall belt scales and a clean-out auger for removing material that has fallen from the belt scales within the enclosure.

The system may include an input bypass arrangement for selectively adding additional portions of the material to the bin and an output bypass arrangement for selectively removing portions of the material from the bin.

PRINCIPAL OBJECTS AND ADVANTAGES OF THE INVENTION

The principal objects and advantages of the present invention include: providing a silo storage system and an asphalt plant having a silo storage system, each having an input device for dynamically monitoring the mass of flowable dry material being introduced into the silo storage system; providing such a silo storage system and an asphalt plant having such a silo storage system, each having an output device for dynamically monitoring the mass of flowable dry material being removed from the silo storage system; providing such a silo storage system and an asphalt plant having such a silo storage system, each having a control unit, cooperating with input and output monitoring arrangements, for dynamically monitoring the mass of flowable dry material contained in the silo storage system; and generally providing such a silo storage system and an asphalt plant having such a silo storage system wherein each is reliable in performance and is particularly well adapted for the proposed usages thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a schematic side elevational view of an asphalt plant having a silo with dynamic input and output mass monitoring devices, according to the present invention.

FIG. 3 is an enlarged and fragmentary, side elevational schematic view of a gravimetric weigh device of the asphalt plant having a silo with dynamic input and output mass monitoring devices.

DETAILED DESCRIPTION OF THE INVENTION

Figure 2:
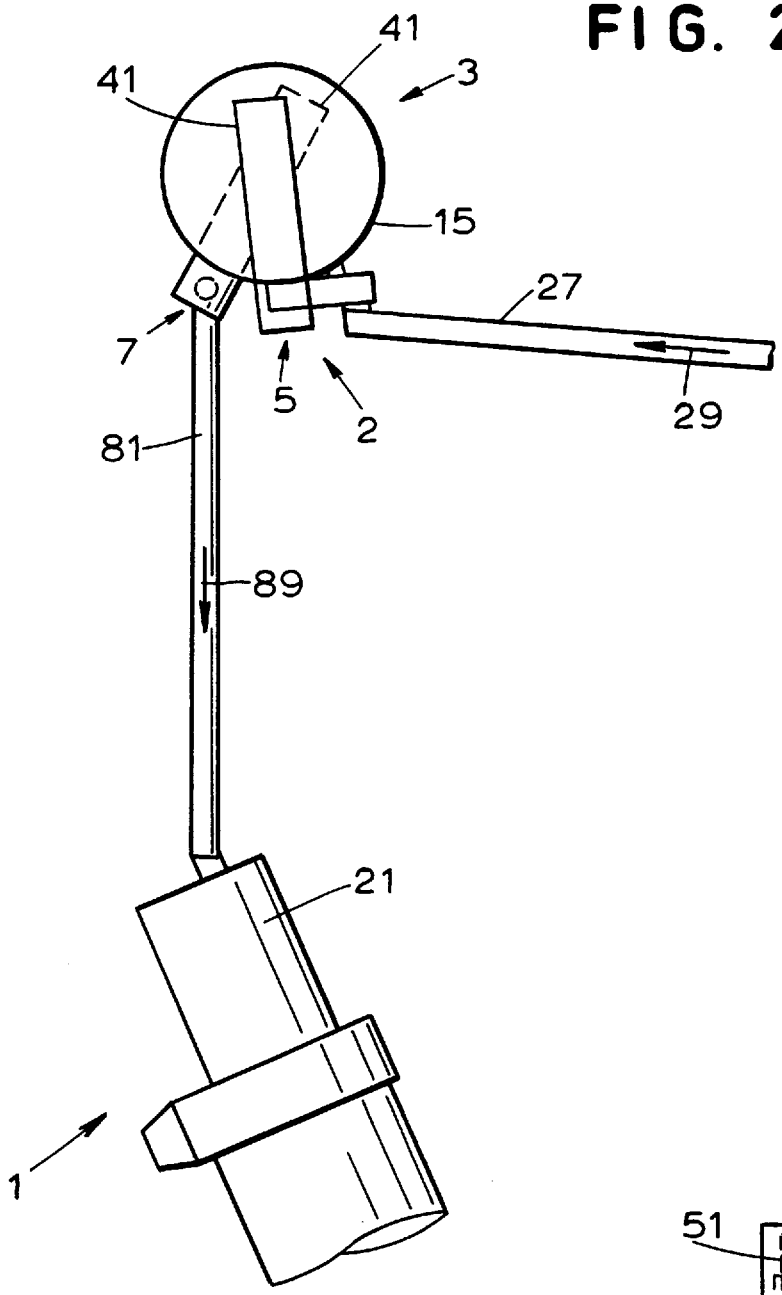
FIG. 2 is a schematic plan view of the asphalt plant having a silo with is dynamic input and output mass monitoring devices.

As required, detailed embodiments of the present invention are disclosed herein; however, it is to be understood that the disclosed embodiments are merely exemplary of the invention, which may be embodied in various forms.

Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally refers to an asphalt plant having a storage silo system 2 with dynamic input and output mass monitoring devices in is accordance with the present invention, as shown in FIGS. 1 through 4. The system 2 generally includes bin means 3, input monitor means 5, output monitor means 7 and control means 9.

The bin means 3 includes a silo 15 on frame means 17 such that the silo 15 is supported in a generally upright configuration, as shown in FIG. 1. The silo 15 comprises an inwardly tapered portion 18, generally representing an inverted cone, having an exit port 20 near a lower extremity thereof. It is to be understood that the silo system 2 may be configured for stationary installation, or as a mobile arrangement whereby the silo system 2 may be readily moved from jobsite to jobsite. In the event of the latter, the silo system 2 would be configured to be self-erecting to simplify setup at each subsequent jobsite.

The bin means 3 is generally configured to contain flowable dry material 19, such as mineral fill, fines, etc., for producing hot mix asphalt or the like in an asphalt plant 21 or for use with other apparatus requiring a controlled supply of the flowable dry material 19.

The flowable dry material 19 may be operably provided by any suitable source such as, for example, a cyclone separator, a baghouse, a combination of a baghouse and a cyclone separator, or any other suitable apparatus (not shown) used to filter airborne particulate matter from a hot gas stream being exhausted from a rotary drum. The flowable dry material 19 is conveyed to the silo 15, such as by a conveyor 27, or other suitable arrangement, as indicated by the arrow designated by the numeral 29 in FIG. 2.

The material 19 transported to the silo 15 by the conveyor 27 is generally transferred to another conveyor 31. The conveyor 31 may be a vertical bucket elevator, a vertical screw auger elevator, or other suitable apparatus adapted to lift the material 19 upwardly, as indicated by the arrow designated by the numeral 33 in FIG. 1, such that the material 19 can be gravitationally transferred to the input monitor means 5, as indicated by the arrows designated by the numeral 35 in FIGS. 3 and 4, and, in turn, to the silo 15, as indicated by the arrows designated by the numeral 37.

Figure 4:
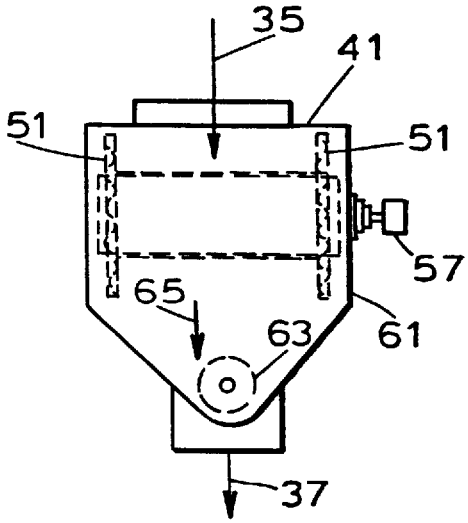
FIG. 4 is an enlarged and fragmentary, end elevational schematic view of one of the gravimetric weigh devices of the asphalt plant having a silo with dynamic input and output mass monitoring devices, according to the present invention.

The input monitor means 5, which includes a gravimetric weigh device 41, is adapted to dynamically monitor the mass of the material 19 being transferred from the conveyor 31 to the silo 15. The gravimetric weigh device 41 includes a flat conveyor 43 having a flexible belt 45 for conveying the material 19 on a upper run 47 thereof, as indicated by the arrow designated by the numeral 49 in FIG. 3. Preferably, vertical members 51 are provided to maintain the material 19 on the belt 45 as the material 19 is being conveyed along the upper run 47, as indicated in FIG. 4.

Spaced beneath the belt 45 is a weigh-bridge mechanism 57, such as a Model 60-12 Speed Sensor in conjunction with an integrator/totalizer as provided by Ramsey Engineering Company of St. Paul, Minn., that is communicatively coupled to the control unit 9, as indicated by the dashed line designated by the numeral 59 in FIG. 1, for monitoring the mass of the material 19 being conveyed from the conveyor 31 to the silo 15. Preferably, the gravimetric weigh device 41 includes a housing 61 for enclosing and protecting the material 19 from outside influences and disturbances as the material 19 is conveyed therethrough from the conveyor 31 to the silo 15.

A cleanout or purging auger 63 is provided in a downwardly depending trough 65 of the housing 61. The cleanout or purging auger 63, driven by a motor 64, and trough 65 are adapted to cooperatively convey portions of the material 19 falling from a return or lower run 67 of the belt 45 into the silo 15, as indicated by the arrow designated by the numeral 69 in FIG. 3.

Situated at the exit port 20 of the inwardly tapered portion 18 of the silo 15 is a rotary vane feeder 77 driven by a variable speed motor 79 or other suitable arrangement whereby the quantity of the material 19 being released to the output monitor means 7 situated therebelow may be controlled.

The output monitor means 7 is generally substantially similar to the input monitor means 5 including the gravimetric weigh device 41 and weigh-bridge mechanism 57 which, in the case of the output monitor means 7, are adapted to dynamically monitor the mass of the material 19 being transferred from the silo 15 to a conveyor 81. The weigh-bridge mechanism 57 of the output monitor means 7 is communicatively coupled to the control unit 9, as indicated by the dashed line designated by the numeral 83 in FIG. 1, for monitoring the mass of the material 19 being conveyed from the silo 15 to the conveyor 81. Also, the auger 63 and trough 65 of the output monitor means 7 are adapted to cooperatively convey portions of the material 19 falling from a return or lower run 67 of the belt 45 into the conveyor 81.

The material 19 received by the conveyor 81 from the output monitor means 7 is conveyed to other equipment, such as the asphalt plant 21, as indicated by the arrow designated by the numeral 89 in FIG. 2. Alternatively, the conveyor 81 may be used to discard the material 19 from the silo 15, if desired, such as when the asphalt plant 21 is not being operated.

The system 2 may also include an input bypass means 91, such as an elevator or other suitable arrangement, for adding additional portions of the material 19 to the silo 15. For example, the input bypass elevator 91 may be used to deposit some of the material 19 into the silo 15 prior to start up of the asphalt plant 15 such that the material 19 would meet demands for the material 19 until the mass of the material 19 being introduced into the silo 15 through the elevator 31 is sufficient to provide the mass of the material 19 being dispensed from the silo 15. As another example, the input bypass elevator 91 may be used to assist the conveyor 31 when the rate that the material 19 being deposited into the silo 15 through the conveyor 31 is less than the rate that the material 19 is being removed from the silo 15 by the conveyor 81. Preferably, the mass of the material 19 being deposited into the silo 15 through the input bypass elevator 91 is monitored by one of the gravimetric weigh devices 41, with such information obtained thereby being communicated to the control unit 9, as hereinbefore described.

Similarly, the system 2 may also include an output bypass elevator 93, such as a chute or auger, for wasting or removing the material 19 from the silo 15. For example, the output bypass chute 93 may be used to remove some of the material 19 from the silo 15 when the rate that the material 19 is being removed from the silo 15 through the conveyor 81 is less than the rate that the material 19 is being deposited into the silo 15 by the conveyor 31. Preferably, the mass of the material 19 being removed from the silo 15 through the output bypass chute 93 is monitored by one of the gravimetric weigh devices 41, with such information obtained thereby being communicated to the control unit 9, as hereinbefore described.

In an application of the present invention wherein the silo 15 is used in conjunction with an asphalt plant 21 and the silo 15 is initially empty, a certain quantity of the material 19 is introduced into the silo 15 by the input bypass elevator 91. A known weight of the material 19 can be introduced into the silo 15, or one of the gravimetric weigh devices 41 may be used in conjunction with the input bypass elevator 91 to dynamically determine the quantity of the material 19 as it is being introduced into the silo 15. The initial quantity of the material 19 contained in the silo is communicated to the control unit 9, such as by keyboard input or other suitable means.

As the asphalt plant 21 is activated, the material 19 is released from the silo 15 through the rotary vane feeder 77 and the output monitor means 7 to the conveyor 81 where the material 19 is conveyed to a rotary drum of the asphalt plant 21. The desired rate at which the material 19 is so removed from the silo 15 may be communicated to the control unit 9, either manually or by signals automatically provided by control mechanisms associated with the asphalt plant 21.

The output monitor means 7 dynamically determines the mass of the material 19 being removed from the silo 15 and communicates that information to the control unit 9 to thereby maintain a real-time indication of the quantity of the material 19 in the silo 15. In addition, the output monitor means 7 provides a feedback capability whereby the rate that the material 19 is being dispensed by the rotary vane feeder 77 is accordingly increased or decreased to correspond with the desired rate automatically or manually input into the control unit 9.

As the asphalt plant 21 continues to operate, additional quantities of the material 19 will be dynamically generated by the asphalt plant 21 as particulate matter being entrained in a hot gas stream within the rotary drum of the asphalt plant 21 is separated from the hot gases in a baghouse or other arrangement. The material 19 separated from the hot gases is conveyed by the conveyors 27 and 31 to the input monitor means 5. The input monitor means 5 dynamically determines the mass of the material 19 passing therethrough and being deposited into the silo 15. That information is communicated to the control unit 9 to thereby, in conjunction with the output monitor means 7, maintain a real-time indication of the quantity of the material 19 in the silo 15, even though the material 19 is continuously and simultaneously being both introduced into and removed from the silo 15.

In the event that the material 19 in the silo 15 is being depleted due to the material 19 being dispensed more rapidly from the silo 15 by the conveyor 81 than the material 19 is being introduced into the silo 15 by the conveyor 31, then supplemental portions of the material 19 may be introduced into the silo 15, either continuously or by batch, by the input bypass means 91. Of course, a gravimetric weigh device 41 may be used in conjunction with the input bypass means 91 and in conjunction with the gravimetric weigh devices 41 of the input monitor means 5 and the output monitor means 7 to provide real-time indication of the quantity of the material 19 in the silo 15.

Similarly, if the silo 15 is becoming filled due to the material 19 being introduced more rapidly into the silo 15 by the conveyor 31 than the material 19 is being dispensed from the silo 15 by the conveyor 81, then portions of the material 19 may be removed from the silo 15, either continuously or by batch, by the output bypass means 93. Again, a gravimetric weigh device 41 may be used in conjunction with the output bypass means 93 and in conjunction with the gravimetric weigh device 41 of the input monitor means 5 and the output monitor means 7 to provide real-time indication of the quantity of the material 19 in the silo 15.

It is to be understood that while certain forms of the present invention have been illustrated and described herein, it is not to be limited to the specific forms or arrangement of parts described and shown.

What is claimed and desired to be secured by Letters Patent is as follows:

1. An asphalt plant for producing asphalt products wherein a rotary drum thereof generates particulate matter that is reusable for producing the asphalt products, said asphalt plant including a silo system configured to operatively and dynamically receive the particulate matter generated by the rotary drum and to operatively and dynamically dispense the particulate matter as needed for producing the asphalt products, the silo system including:

bin means for receiving, containing and dispensing the particulate matter;

input monitor means for dynamically monitoring the mass of the particulate matter being received by the bin means;

output monitor means for dynamically monitoring the mass of the particulate matter being dispensed from the bin means; and control means for determining, in cooperation with the output monitor means, the mass of the particulate matter contained in the bin means.

2. The asphalt plant according to claim 1, wherein each of said input monitor means and said output monitor means includes a gravimetric weigh device.

3. The asphalt plant according to claim 1, wherein at least one of said input monitor means and said output monitor means includes a gravimetric weigh device.

4. The asphalt plant according to claim 3, wherein said gravimetric weigh device includes continuous weigh, flexible wall belt scales.

5. The asphalt plant according to claim 3, wherein said gravimetric weigh device is substantially enclosed.

6. The asphalt plant according to claim 5, wherein said gravimetric weigh device includes a purging auger.

7. The asphalt plant according to claim 1, including output bypass means for removing additional portions of the particulate matter from said bin means.

8. The asphalt plant according to claim 1, including input bypass means for automatically adding supplemental portions of the particulate matter to said bin means.

9. The asphalt plant according to claim 1, including a valve configured to operatively control the rate at which the particulate matter is dispensed from said bin means wherein said valve is controlled by said output monitor means.

10. On an asphalt plant for producing asphalt products and having a rotary drum capable of generating reusable particulate matter for use in the asphalt products, a silo system, comprising:

a bin for storing the particulate matter and having an input and an output for receiving and dispensing, respectively, the particulate matter;

an input monitor for monitoring the amount of particulate matter entering the bin;

an output monitor for monitoring the amount of particulate matter exiting the bin; and a control system operatively connected to the input and output monitors for determining the amount of particulate matter present in the bin.

11. The silo system of claim 10, wherein each of the input and output monitors includes a gravimetric weigh device.

12. The silo system of claim 11, wherein each gravimetric weigh device includes a flexible continuous belt.

13. The silo system of claim 12, wherein each of the flexible belts includes a pair of flexible sidewalls.

14. The silo system of claim 11, wherein each of the gravimetric weigh devices is substantially enclosed.

15. The silo system of claim 10, wherein each of the input and output monitors includes a purging auger.

16. The silo system of claim 10, including an output bypass for removing an additional quantity of particulate matter from the bin.

17. The silo system of claim 10, including an input bypass for adding an additional quantity of particulate matter to the bin.

18. The silo system of claim 10, including a rotary vane feeder at the output for controlling the delivery rate of particulate matter exiting the bin.

19. An asphalt plant for producing asphalt products and having a rotary drum capable of generating reusable particulate matter for use in the asphalt products, comprising:

a buffering system having a bin for storing the particulate matter, the bin having an input and an output for receiving and dispensing, respectively, the particulate matter;

monitoring means including an input monitor for monitoring the amount of particulate matter entering the bin, and an output monitor for monitoring the particulate matter exiting the bin; and a controller operatively connected to the monitoring means for determining the amount of particulate matter present in the bin.

* * * * *